US012241345B2

(12) United States Patent
Gambaretto et al.

(10) Patent No.: US 12,241,345 B2
(45) Date of Patent: Mar. 4, 2025

(54) AUTOMATED SYSTEM FOR MANAGING ANNULAR GAS IN A PRODUCTION WELL

(71) Applicant: Schlumberger Technology Corporation, Sugar Land, TX (US)

(72) Inventors: Agustin Gambaretto, Houston, TX (US); Attilio Pisoni, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 4 days.

(21) Appl. No.: 18/263,903

(22) PCT Filed: Feb. 3, 2022

(86) PCT No.: PCT/US2022/070497

§ 371 (c)(1),
(2) Date: Aug. 2, 2023

(87) PCT Pub. No.: WO2022/170330

PCT Pub. Date: Aug. 11, 2022

(65) Prior Publication Data

US 2024/0117719 A1 Apr. 11, 2024

Related U.S. Application Data

(60) Provisional application No. 63/199,940, filed on Feb. 4, 2021.

(51) Int. Cl.

| | |
|---|---|
| ***E21B 43/12*** | (2006.01) |
| ***E21B 34/02*** | (2006.01) |
| ***E21B 47/06*** | (2012.01) |

(52) U.S. Cl.

CPC ..... *E21B 43/121* (2013.01); *E21B 34/02* (2013.01); *E21B 47/06* (2013.01)

(58) Field of Classification Search

CPC ..... E21B 43/128; E21B 43/121; E21B 43/12; E21B 2200/22

See application file for complete search history.

(56) References Cited

U.S. PATENT DOCUMENTS 11,795,787 B2 * 10/2023 Sandnes ..... G06F 30/27
2007/0175633 A1 * 8/2007 Kosmala ..... E21B 47/008 166/250.15

(Continued)

FOREIGN PATENT DOCUMENTS

WO 2012166573 A2 12/2012
WO 2019051561 A1 3/2019

OTHER PUBLICATIONS

Search Report and Written Opinion of International Patent Application No. PCT/US2022/070497 dated May 16, 2022, 10 pages.

*Primary Examiner* — Tara Schimpf
*Assistant Examiner* — Ursula Lee Norris
(74) *Attorney, Agent, or Firm* — Jeffrey D. Frantz

(57) ABSTRACT

An automated system for managing gas in an annulus of a production well at a well site, the automated system including: an electrically-controlled valve fluidly coupled to the annulus of the production well, wherein the valve is located at or near the surface at the well site; at least one well sensor configured to measure operational characteristics of the production well at or near the surface; and a gateway device, located at the well site and operably coupled to the valve and the at least one well sensor, wherein the gateway device is configured to collect first sensor data communicated from the at least one well sensor, and process the first sensor data in autonomous control operations that automatically generate and issue commands that are communicated from the gateway device to the valve to regulate the outflow of accumulated gas from the annulus of the production well over time.

20 Claims, 7 Drawing Sheets

(56) References Cited

U.S. PATENT DOCUMENTS

| | | | | |
|---|---|---|---|---|
| 2012/0048546 | A1 | 3/2012 | Ndinemenu | |
| 2015/0368999 | A1* | 12/2015 | Massa de Campos | E21B 33/0355 700/282 |
| 2016/0138351 | A1* | 5/2016 | Dillard | E21B 33/128 175/25 |
| 2018/0266209 | A1* | 9/2018 | Singal | E21B 43/128 |
| 2019/0153821 | A1 | 5/2019 | Douglas | |

* cited by examiner

AUTOMATED SYSTEM FOR MANAGING ANNULAR GAS IN A PRODUCTION WELL

CROSS-REFERENCE TO RELATED APPLICATION(S)

The present disclosure is the National Stage Entry of International Application No. PCT/US2022/070497, filed Feb. 3, 2022, which claims priority from U.S. Provisional Patent Appl. No. 63/199,940, filed on Feb. 4, 2021, herein incorporated by reference in its entirety.

FIELD

The subject disclosure relates to systems and methods for management of annular gas in a production well.

BACKGROUND

Many production wells employ an Artificial Lift System (ALS) that is operated to lift produced fluids to the surface. Examples of common Artificial Lift Systems include an Electric Submersible Pump (ESP), Progressive Cavity Pump (PCP), and Rod Pump. A production well that employs an ALS can be completed without a downhole packer isolating the bottom-hole portion of the production well and the reservoir from the wellhead at the surface. This type of completion allows gas to separate from the liquid phase of the produced fluids downhole, which improves the efficiency of the ALS as the productivity of the ALS can deteriorate with increasing Gas Volume Fraction (GVF) at the intake of the ALS. The annular space (or annulus) of the production well between the production tubing and the casing of the well then becomes a huge vertical separator that allows gas to flow through this annular space up to the wellhead. The gas that flows through this annular space is referred to as annular gas herein.

The accumulation of gas in the annulus of the production well increases the pressure in the annulus over time. This phenomenon can generate back pressure downhole in the reservoir, reduce the deliverability of the reservoir fluids to the surface, and impact the efficiency of the ALS. Specifically, the gas accumulation in the annulus of the production well can create reservoir backpressure that negatively impacts production from the well, and potentially reduces the efficiency of the ALS due to suboptimal intake pressure. The gas accumulation in the annulus of the production well can also lead to production system issues (such as gas lock) depending on the volume and associated gas.

For example, the accumulation of gas in the annulus of the production well can increase both pressure of the accumulated gas at or near the surface (which is referred to herein as Casing Head Pressure or CHP) and downhole pressure at the intake section of the ALS (which is referred to herein as Pump Intake Pressure or PIP). The increase to CHP and/or PIP can lead to production issues including production losses and gas lock.

With respect to production losses, the increase in PIP can proportionally reduce the productivity of the well. Furthermore, the increase in PIP can increase the Gas Volume Fraction (GVF) at the intake section of the ALS, hence, reducing the efficiency of the ALS and well productivity. In order to address annular gas accumulation and mitigate the production losses associated therewith, field technicians are often required to travel to the well site and open a manually-actuated gate valve to release the gas that accumulates in the annulus of the production well. This process can lead to repetitive interventions increasing response time, production losses, and costs and health and safety concerns associated with driving and personnel exposure. Also, the manual actuation of the gate valve can be inconsistent, which leads to several iterative manipulations in order to control the production well without ever finding the right valve position, particularly in the case that the natural instability of the production well requires varying controlling conditions, hence constant control and manipulation.

With respect to gas lock, sudden variations in CHP infers variations in the liquid submergence level of the ALS, which lead to sudden variations in the PIP. Most ALS installations are configured with an alarm that will trigger with falling PIP. When the alarm is triggered, the ALS (i.e., pump) is stopped to avoid gas entering the ALS and the production stops. When the ALS installation is not configured with an alarm, a gas lock event can occur leading to a halt in production. In the gas lock event, gas interferes with the proper operation of ALS, preventing fluid from entering and leaving the ALS such that ALS is locked. In order to address and mitigate annular gas accumulation and the gas lock issues associated therewith, field technicians are required to travel to the well site and bring the ALS back online. Furthermore, the field technicians typically open the manually-actuated gate valve to release the gas that accumulates in the annulus of the production well. This process can also lead to repetitive interventions increasing response time, production losses, and costs and health and safety concerns associated with driving and personnel exposure. Also, the manual manipulation of the gate valve can be inconsistent, which leads to several iterative manipulations in order to control the production well without ever finding the right valve position, particularly in the case that the natural instability of the production well requires varying controlling conditions, hence constant control and manipulation.

SUMMARY

In embodiments, automated systems and methods are provided for managing annulus gas in a production well. The system includes an automated pressure control system fluidly coupled to the annulus of the production well in order to manage pressure and gas flow through the annulus.

In embodiments, the automated pressure control system includes an electrically-controlled valve, at least one well sensor, and an edge gateway device. The valve is fluidly coupled to the annulus of the production well. The valve can be located at or near the surface at the well site. The at least one well sensor is configured to measure operational characteristics of the production well at or near the surface. The gateway device is located at the well site and operably coupled to the valve and the at least one well sensor. The gateway device is configured to collect first sensor data communicated from the at least one well sensor, and process the first sensor data in autonomous control operations that automatically generate and issue commands that are communicated from the gateway device to the valve to regulate the outflow of accumulated gas from the annulus of the production well over time.

In embodiments, the at least one well sensor can include a pressure sensor configured to measure casing head pressure of the production well at or near the surface. In this configuration the first sensor data can include sensor data that represents casing head pressure measured by the pressure sensor.

In embodiments, the gateway device can be further configured to use a setpoint value for casing head pressure in the autonomous control operations.

In embodiments, the production well can employ an artificial lift system (ALS) to lift fluids through the production well to the surface. The ALS can include at least one ALS sensor that measures operational characteristics of the ALS. The gateway device can be operably coupled to the at least one ALS sensor. The gateway device can be configured to collect second sensor data communicated from the at least one ALS sensor, and process both the first sensor data and the second sensor data in autonomous control operations that automatically generate and issue commands that are communicated from the gateway device to the valve to regulate the outflow of accumulated gas from the annulus of the production well over time.

In embodiments, the at least one ALS sensor can include a downhole sensor configured to measure pump intake pressure. In this case, the second sensor data can include sensor data that represents pump intake pressure measured by the downhole sensor.

In embodiments, the gateway device can be further configured to use a setpoint value for pump intake pressure in the autonomous control operations.

In embodiments, the gateway device can be configured to execute a computational model that calculates a liquid submergence level for the ALS based on the first sensor data and second sensor data. The gateway device can be further configured to use the liquid submergence level in the autonomous control operations.

In embodiments, the computational model can be configured to calculate the liquid submergence level for the ALS based on first sensor data representing casing head pressure data and second sensor data representing pump intake pressure and pump discharge pressure.

In embodiments, the computational model can be further configured to calculate the liquid submergence level for the ALS based on other inputs specific to the production well.

In embodiments, the gateway device can be further configured to use a setpoint value for liquid submergence level in the autonomous control operations.

In embodiments, the gateway device can be further configured to execute a computational model that calculates a virtual flow rate of produced fluid based on the first sensor data and second sensor data. The gateway device can be further configured to communicate the virtual flow rate of produced fluid as calculated by the gateway device over time to a remote system.

In embodiments, the gateway device can be further configured to communicate time-series operational data of the ALS and the automated system to a remote system for monitoring and visualization of operating conditions and status of the ALS and the automated system.

In embodiments, the time-series operational data can include a virtual flow rate of produced fluid calculated by the gateway device based on the first sensor data and second sensor data.

In embodiments, the remote system can be embodied by a cloud computing environment.

In embodiments, the gateway can be configured to receive communication from the remote system for remote control of the valve.

In embodiments, the valve and the at least one well sensor can be mounted on a skid that is located at the well site.

In embodiments, the gateway device can include at least one communication interface providing direct or indirect communication between the gateway device and the valve and the at least one well sensor.

In embodiments, the ALS of the production well can employ one of an Electrical Submersible Pump, a Progressive Cavity Pump, and a Rod Pump.

In embodiments, the autonomous control operations can be configured to perform at least one of the following: (a) stabilize and optimize the liquid submergence level of the ALS; (b) control the production well under dynamic variations that happen randomly in unstable wells; (c) control pressure build up and pressure losses on the annulus of the production well (d) indirectly control liquid rate and productivity of the production well; (e) improve pump efficiency and fluid GVF; and (f) improve run life of the ALS.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

Figure 1:
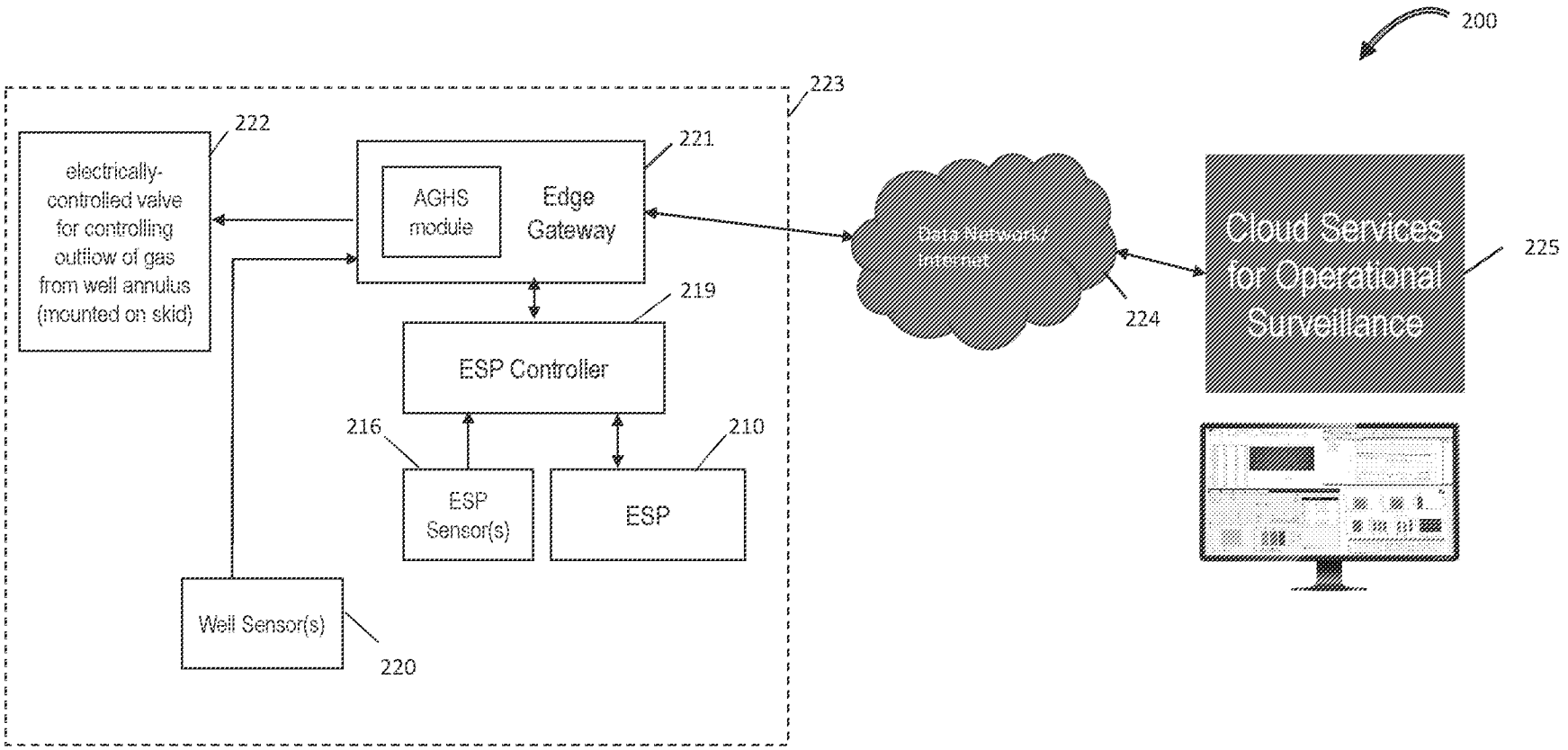
FIGS. 1 and 2, collectively, are schematic diagrams that depict an embodiment of the subject disclosure.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

The present disclosure is directed to an autonomous annular gas handling system (AGHS) that optimizes production by automatically controlling an electrically-controlled valve to regulate the outflow of accumulated gas from the annulus of a production well over time and avoid the gas-related issues that impact the operation and performance of an ALS over time. The automatic control of the electrically-controlled valve can reduce human intervention and associated costs of the production well over time. In embodiments, the automatic control of the electrically-controlled valve can be configured to optimize the intake pressure of the ALS and the liquid submergence level of the ALS and minimize the potential for gas lock of the ALS, all of which contribute to optimizing production of fluids from the well.

In embodiments, the automated annular gas handling system (AGHS) can employ software-based control logic (e.g., automated, smart control functionality) that is implemented on a gateway device located at or near the well site. The software-based control logic can be configured to automatically issue commands that control the electrically-controlled valve to regulate the outflow of accumulated gas from the annular space of the production well over time. Such control logic can evaluate real-time ALS sensor data (such as sensor data representing PIP measured by a downhole pressure sensor, and/or sensor data representing downhole pressure at the discharge section of the ALS (Pump Discharge Pressure) as measured by a downhole pressure sensor), real-time well sensor data (such as sensor data representing CHP measured by a pressure sensor located at or near the surface, and sensor data representing pressure of the produced fluids (production stream) at the surface (Wellhead Pressure) as measured by a pressure sensor located at or near the surface), and possibly other data to automatically generate and issue commands that control the electrically-controlled valve to regulate the outflow of accumulated gas from the annulus of the production well over time. In embodiments, the commands can specify a percentage of opening for the valve. Alternatively, the commands can adjust the opening of the valve to maintain a specific setpoint value (such as a setpoint CHP or setpoint PIP or setpoint liquid submergence level). In this mode, the valve is adjusted automatically in order to maintain the specific set point value.

The software-based control logic can employ computational models that calculate a real-time virtual flow rate of produced fluids and a liquid submergence level of the ALS based on predefined set of inputs, including real-time sensor data (such as real-time sensor data representing PIP, and real-time sensor data representing Pump Discharge Pressure), real-time well sensor data (such as real-time sensor data representing CHP, and real-time sensor data representing Wellhead Pressure), and other information specific to the well (such as well information and fluid properties). The real-time virtual flow rate and/or the liquid submergence level of the ALS as calculated by the computational models can be evaluated by the control logic (possibly in combination with the real-time ALS sensor data and/or real-time well sensor data) to automatically generate and issue commands that control the electrically-controlled valve to regulate the outflow of accumulated gas from the annulus of a well over time. The real-time virtual flow rate and a liquid submergence level of the ALS as calculated by the computational models can be visualized with other parameters to ensure proper implementation of the well optimization by the AGHS.

In embodiments, the autonomous operation of the software-based control logic that executes on the gateway device can be configured to control the valve to regulate the outflow of accumulated gas from the annulus of the production well over time in a manner that addresses annular gas accumulation and mitigates the issues of production losses and gas lock associated therewith. Furthermore, the autonomous operation of the software-based control logic can improve response time, precision, productivity of the well, and run life of the ALS. It can also avoid the costs and health and safety concerns associated with driving and personnel exposure that is associated with manual intervention of the annular gas accumulation by field personnel.

In embodiments, parts of the AGHS, such as the pressure sensor that measures CHP, the electrically-controlled valve, an inlet hose leading to the electrically-controlled valve, an outlet hose leading from the electrically-controlled valve, an orifice plate flowmeter, a radio for data communication to the gateway device, a solar panel and batteries for supply of electrical power to the local electrical components of the AGHS, and possibly other parts, can be integrated into a skid that is located at the well site.

Figure 2:
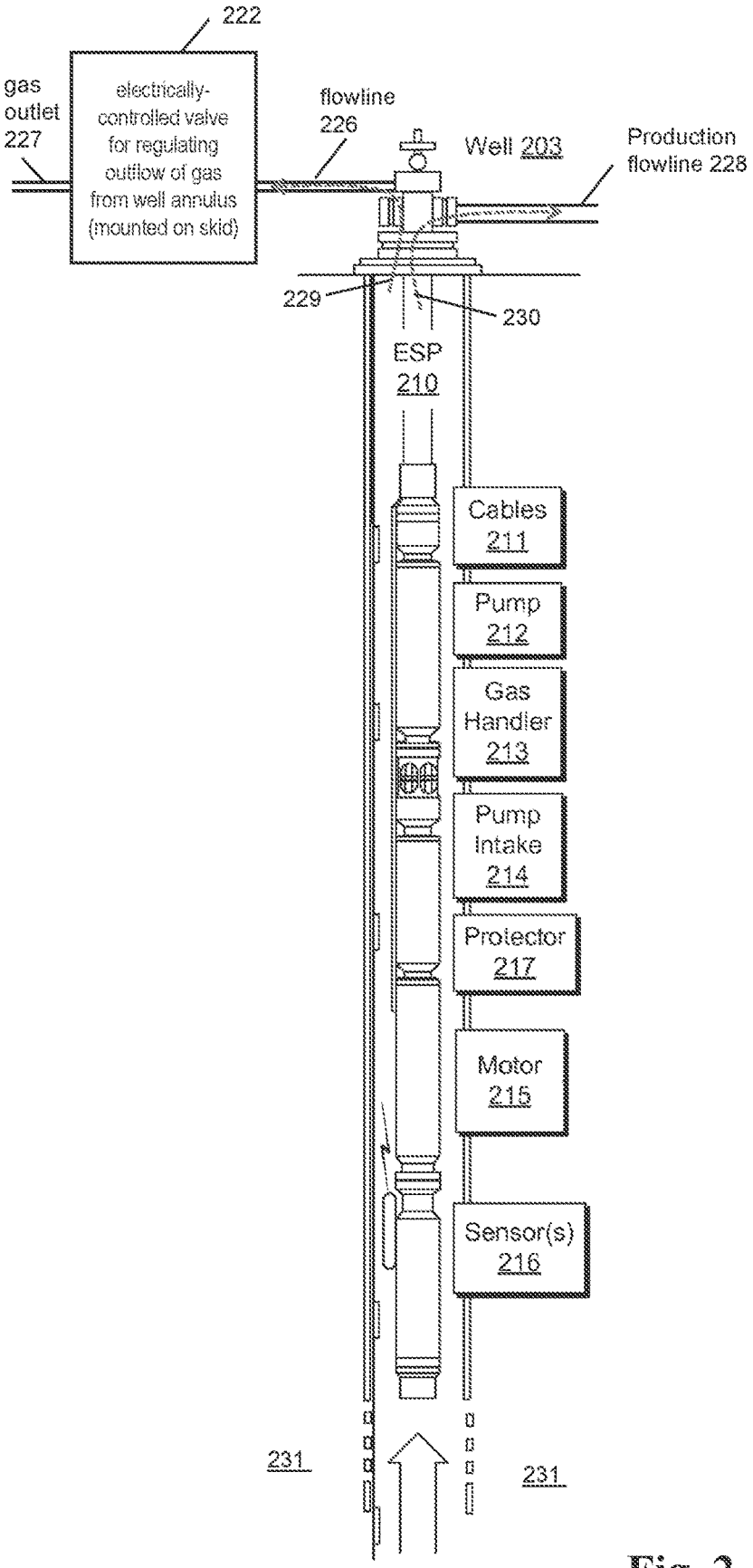

In an example embodiment shown in FIGS. 1 and 2, an AGHS 200 includes an edge gateway device 221 that is located at or near a well site 223. The gateway device 221 is a ruggedized computing device that can be configured to deliver performance edge computing and secure data ingestion. The gateway device 221 can be configured to enable real-time monitoring and control of the physical asset(s) at the well site 223.

The gateway device 221 can be configured to receive, collect, and aggregate data from a variety of operational equipment at the well site 223 (such as sensors, controllers, actuators, programmable logic controllers, remote terminal units, and supervisory control and data acquisition (SCADA) systems), prepare such data for transmission to a remote system 225, and transmit the data from the gateway device 221 to the remote system 225 over a data communication network 224 as shown in FIG. 1. The data communication network 224 can be a cellular data network, satellite link, Internet, or other mode of available data communication. The remote system 225 can be implemented by a cloud computing environment or other processor-based system.

In embodiments, the gateway device 221 can employ a compact and rugged NEMA/IP rated housing for outdoor use, making it suitable for the environments at well sites and facilities. The overall packaging can also be environmentally qualified.

In embodiments, the gateway device 221 can be configured with a bi-directional communication interface (referred to as a Southbound Interface) for data communication to the physical asset(s) at the well site 223 using either a wired communication protocol (such as a serial, Ethernet, Modbus or Open Platform Communication (OPC) protocol) or a wireless communication protocol (such as IEEE 802.11 Wi-Fi protocol, Highway Addressable Remote Transducer Protocol (HART), LoraWAN, WiFi or Message Queuing Telemetry Transport (MQTT)). The Southbound Interface can provide for direct data communication to the physical asset(s) at the well site 223. Alternatively, the Southbound Interface can provide for indirect data communication to the physical asset(s) at the well site 223 via a local area network or other local communication devices.

In embodiments, the gateway device 221 can be configured with a bi-directional communication interface (referred to as a Northbound Interface) to the data communication network 224 using a wireless communication protocol. In embodiments, the wireless communication protocol can employ cellular data communication, such as 4G LTE data transmission capability (or possibly 3G data transmission for fallback capability). For facilities (e.g., well sites) without a cellular signal, the Northbound Interface to the data communication network 224 can be provided by a bidirectional satellite link (such as a BGAN modem). Alternatively, the Northbound Interface can implement other wireless communication protocols or wired communication protocols.

In embodiments, the gateway device 221 can employ an embedded processing environment (e.g., data processor and memory system) that hosts and executes an operating system and application(s) or module(s) as described herein.

In embodiments, the gateway device 221 can employ both hardware-based and software-based security measures. The hardware-based security measures can involve a hardware root-of-trust established using an industry standard Trusted Platform Module (TPM) v2.0 cryptographic chip. The software-based security measures can include operating system hardening and encryption of both buffered and transmitted data.

In embodiments, the gateway device 221 can support a containerized microservice-based architecture. This architecture enables extensibility into several distinct and different solutions for different environments and applications at the edge, while still using the same infrastructure components. In embodiments, the gateway device 221 can employ one or more containers to implement one or more applications or modules executing on the gateway device 221, such as the AGHS module(s) described herein. A container is a standard unit of software that packages up code and all its dependencies (such as runtime environment, system tools, system libraries and settings) so that the application or module runs quickly and reliably in the computing environment of the gateway device 221. The container isolates the software from its environment and ensures that it works uniformly and reliably in the computing environment of the gateway device 221.

In embodiments, the Southbound Interface of the gateway device 221 interfaces to an ESP Controller 219 that controls the operation of an ESP 210 deployed in a production well 203 at the well site 223 (FIG. 2). The ESP 210 provides a means of artificial lift to produce reservoir fluids (e.g., petroleum fluids) from a subsurface earth formation (reservoir) 231 through the production well 203 to the surface.

In the example embodiment shown in FIG. 2, the ESP 210 includes one or more cables 211, a pump 212, gas handling features 213, a pump intake 214, a motor 215, one or more ESP sensors 216, and optionally a protector 217. The ESP sensor(s) 216 are configured to measure in real-time, operating parameters or conditions of the ESP 210, such as temperature, pressure at the pump intake 214 or PIP, pressure at the discharge section of the pump 212, strain, current leakage, vibration, etc. The cables 211 carry electrical power supply signals to the motor 215 for operating the ESP 210. The power supply signals may be derived from mains power (e.g., power grid), an onsite generator (e.g., natural gas-driven turbine), or other electrical power source. The cables 211 also provide for data communication of the sensor data measured by the ESP sensor(s) 216 to the ESP Controller 219.

The production well 203 includes a wellhead that provides a flowpath from the annulus of the production well 203 to a flowline 226 that leads to the electrically-controlled valve 222. During operation of the ESP 210, gas can accumulate in the annulus of the production well 203 as described herein. The electrically-controlled valve 222 can be controlled by commands communicated thereto to control the outflow of gas from the annulus of the production well 203 to a gas outlet 227. The outflow of gas from the annulus of the production well 203 is labeled by dashed arrow 229. In embodiments, the electrically-controlled valve 222 can be pressure relief valve, needle valve, choke valve, or other valve type. The valve is typically actuated by a motor or other actuation means whose operation is controlled according to commands communicated to the valve assembly. The gas outlet 227 can be fluidly coupled to a downstream system (not shown). The downstream system can be a vent, a gas flare, a system that injects the gas into the production flowline 228, or other systems suited to any specific layout and requirement specified by a client. Note that if the pressure downstream of the valve 222 is higher than the inlet pressure of the valve 222, components including but not limited to gas compressors, surface jet pumps, and eductors, can be introduced in the system allowing proper disposition of the gas stream into the downstream system.

The wellhead of the production well 203 can also include a choke or choke valve that is operated to control various well operations, such as controlling the wellhead pressure to control the flow rate of produced fluids from the production well to the production flowline 228. The flow of produced fluids from the well is labeled by dashed arrow 230. The wellhead can also include one or more sensors or meters such as a temperature sensor, a pressure sensor for measuring wellhead pressure, a solids sensor, a flow meter, etc.

Referring back to FIG. 1, the ESP Controller 219 interfaces to the ESP sensor(s) 216. The Southbound Interface between the gateway device 221 and the ESP Controller 219 carries the real-time sensor data measured by the ESP sensor(s) 216 over time. The gateway device 221 can collect and/or aggregate and/or otherwise process in real-time the sensor data generated by the ESP sensor(s) 216 and communicated from the ESP Controller 219 in real-time.

The Southbound Interface of the gateway device 221 is also configured to receive real-time sensor data communicated from one or more well sensors 220 that measure operating parameters or conditions of the production well, such as CHP and/or Wellhead Pressure. The real-time sensor data can be communicated directly from the well sensor(s) 220 to the Southbound Interface of the gateway device 221. Alternatively, the real-time sensor data can be communicated indirectly from the well sensor(s) 220 to one or more intermediate devices that forwards the sensor data to the Southbound Interface of the gateway device 221. The gateway device 221 can collect and/or aggregate and/or otherwise process in real-time the sensor data generated by the well sensor(s) 220 and communicated to the gateway device 221.

The Southbound Interface of the gateway device 221 is also configured to interface to the valve 222 to enable the gateway device 221 to issue and communicate commands to the valve 222 that control the valve 222 to regulate the outflow of accumulated gas from the annulus of the production well 203 over time as described herein.

In embodiments, the gateway device 221 employs software-based control logic that executes as an application or module on the gateway device 221. The software-based control logic (labeled AGHS model in FIG. 1) is configured to automatically (i.e., without human input) generate and issue commands that control the electrically-controlled valve 222 to regulate the outflow of accumulated gas from the annulus of the production well 203 over time. Such control logic can evaluate real-time ESP sensor data communicated from the ESP sensor(s) 216 (such as sensor data representing PIP, and/or sensor data representing Pump Discharge Pressure), real-time well sensor data communicated from the well sensor(s) 220 (such as sensor data representing CHP, and sensor data representing Wellhead Pressure), and possibly other data to automatically generate and issue the commands that control the valve 222 to regulate the outflow of accumulated gas from the annulus of the production well 203 over time. In embodiments, the commands can specify a percentage of opening for the valve 222. Alternatively, the commands can adjust the opening of the valve 222 to maintain a specific setpoint value (such as a setpoint CHP or setpoint PIP or setpoint liquid submergence level). In this mode, the valve is adjusted automatically in order to maintain the specific set point value.

In embodiments, the software-based control logic can employ computational models that calculate a real-time virtual flow rate of produced fluids and a liquid submergence level of the ESP based on a predefined set of inputs, including the real-time ESP sensor data communicated from the ESP sensor(s) 216 (such sensor data representing PIP, and sensor data representing Pump Discharge Pressure), the real-time well sensor data communicated from the well sensor(s) 220 (such as sensor data representing CHP, and sensor data representing Wellhead Pressure), and other information specific to the production well 203 (such as well information and fluid properties). The real-time virtual flow rate and/or the liquid submergence level of the ESP as calculated by the computational models can be evaluated by the control logic (possibly in combination with the real-time ESP sensor data and/or real-time well sensor data) to automatically generate and issue commands that control the valve 222 to regulate the outflow of accumulated gas from the annulus of the production well 203 over time. The real-time virtual flow rate and a liquid submergence level of the ESP as calculated by the computational models of the AGHS as well as the real-time data from the well sensor(s) 220 and/or the ESP sensor(s) can be communicated as time-series data communicated to the remote system 225, where such data can be collected, stored, and visualized with other parameters to ensure proper implementation of the well optimization by the AGHS.

In embodiments, parts of the AGHS, such as the well sensor 220 that measures CHP, the valve 222, an inlet hose leading to the valve 222, an outlet hose leading from the valve 222, an orifice plate flowmeter, a radio for data communication to the gateway device 221, a solar panel and batteries for supply of electrical power to local electrical components of the AGHS, and possibly other parts, can be integrated into a skid that is located at the well site 223.

The real-time sensor data collected and/or aggregated and/or otherwise processed by the gateway device 221 as well as the operational data calculated by the gateway device (such as the calculated flow rate and liquid submergence level) can be communicated over the Northbound Interface of the gateway device 221 to the data network 224 for communication to the remote system 225. The remote system 225 can be embodied by a cloud computing environment where such data can be collected, stored, and visualized with other parameters to ensure proper implementation of the well optimization by the AGHS as well as proper operation of the ESP 210.

The remote system 225 can include services that provide for monitoring and visualization of operating conditions and status of the AGHS, which is referred to as operational surveillance of the AGHS. Such services are typically embodied by software executing in a computing environment, such as a cloud computing environment. In this environment, the gateway device 221 collects or generates time-series data (e.g., high frequency real-time operational data) that characterize operation of the AGHS and forwards such times-series data to the remote system 225. The remote system 225 can employ one or more machine learning systems or computational models to detect or predict anomalies in the operation of the AGHS and plan operations to address such anomalies. Such operations can involve communicating commands from the remote system 225 to the gateway device 221 for remote control of the AGHS (including remote control of the valve 222) or scheduling manual intervention of the AGHS at the well site 223, if necessary.

The remote system 225 can include services that provide for monitoring and visualization of operating conditions and status of the ESP 210, which is referred to as operational surveillance of the ESP. Such services are typically embodied by software executing in a computing environment, such as a cloud computing environment. In this environment, the gateway device 221 collects or generates time-series data (e.g., high frequency real-time operational data) that characterize operation of the ESP 210 and forwards such times-series data to the remote system 225. The remote system 225 can employ one or more machine learning systems or computational models to detect or predict anomalies in the operation of the ESP 210 and plan operations to address such anomalies. Such operations can involve communicating commands from the remote system 225 to the gateway device 221 for remote control of the ESP 210 or scheduling manual intervention of the ESP 210 at the well site 223.

In embodiments, the autonomous operation of the software-based control logic that executes on the gateway device 221 can be configured to control the valve 222 to regulate the outflow of accumulated gas from the annulus of the production well 203 over time in a manner that addresses annular gas accumulation and mitigates the issues of production losses and gas lock associated therewith. Furthermore, the autonomous operation of the software-based control logic can improve response time, precision, productivity of the production well, and run life of the ESP. It can also avoid the costs and health and safety concerns associated with driving and personnel exposure that is associated with manual intervention of the annular gas accumulation by field personnel.

Figure 3:
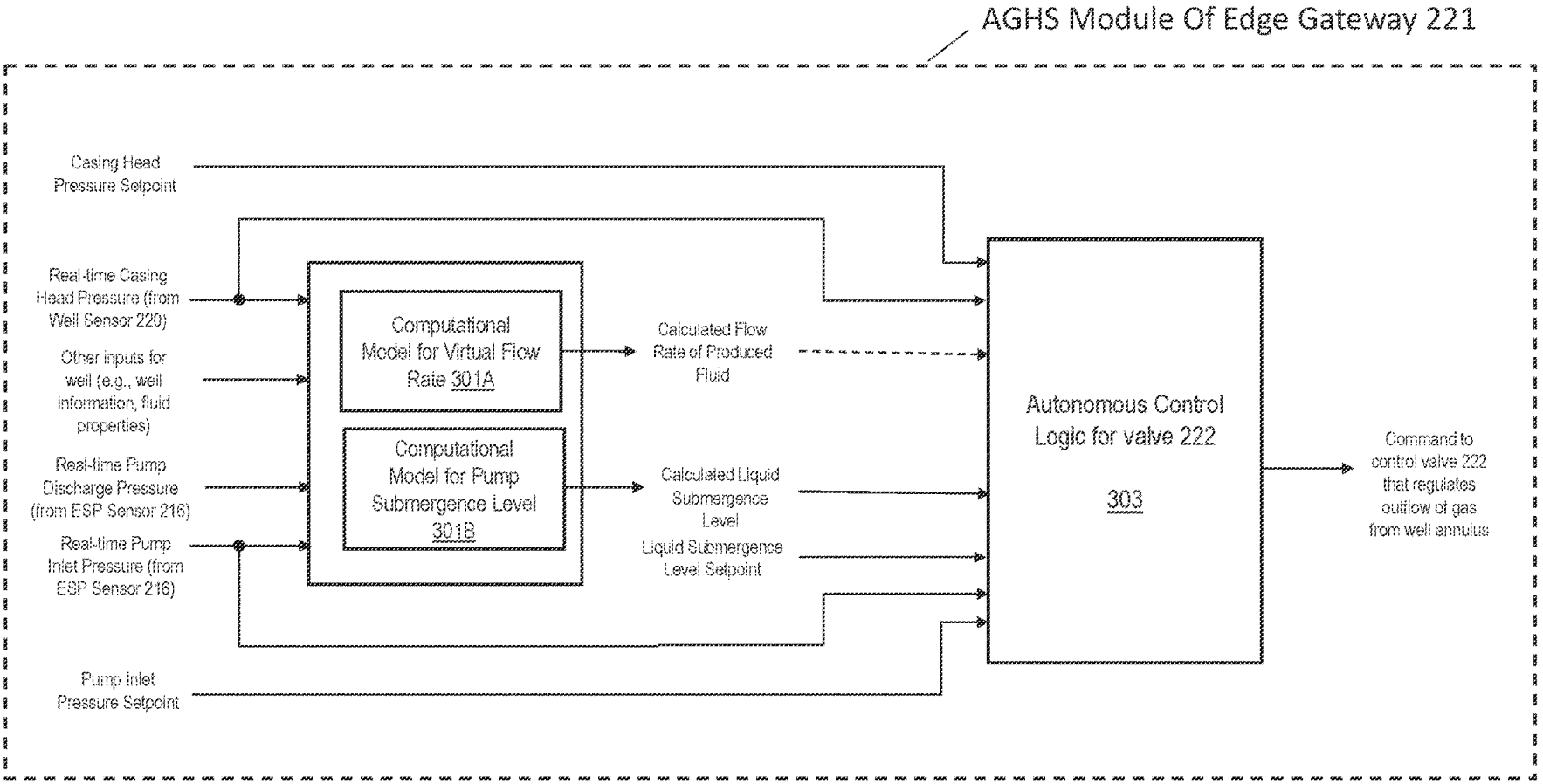
FIG. 3 is a schematic block diagram illustrating autonomous control functionality embodied by the edge gateway device of the embodiment of FIGS. 1 and 2.

FIG. 3 is a schematic block diagram that illustrates an embodiment of the software-based control logic (labeled AGHS Module) that executes as an application on the gateway device 221. The control logic includes a computational model 301A that calculates a real-time virtual flow rate of produced fluids based on a predefined set of inputs, including real-time ESP sensor data communicated from the ESP sensor(s) 216 (such as sensor data representing PIP, and sensor data representing Pump Discharge Pressure), real-time well sensor data communicated from the well sensor(s) 220 (such as sensor data representing CHP), and other information specific to the production well 203 (such as well information and fluid properties). The control logic also includes a computational model 301B that calculates a real-time liquid submergence level of the ESP based on a predefined set of inputs, including real-time ESP sensor data communicated from the ESP sensor(s) 216 (such sensor data representing PIP, and sensor data representing Pump Discharge Pressure), real-time well sensor data communicated from the well sensor(s) 220 (such as sensor data representing CHP), and other information specific to the production well 203 (such as well information and fluid properties). Control logic 303 evaluates the real-time virtual flow rate and/or the liquid submergence level of the ESP as calculated by the computational models 301A, 301B and the real-time ESP sensor data and/or real-time well sensor data and setpoints for CHP, PIP and Liquid Submergence Level to automatically (without human input) generate and issue commands that control the valve 222 to regulate the outflow of accumulated gas from the annulus of the production well 203 over time. In embodiments, the CHP setpoint can be defined by manual human input (or automatic processing) and stored in electronic form for used by the control logic 303. The PIP setpoint can be defined by an alarm setting that corresponds to lowest possible PIP. The PIP of the ESP is driven by the Liquid Submergence Level, so if the Liquid Submergence Level is varying, the setpoint for the Liquid Submergence Level is defined to provide a good buffer zone to avoid the Liquid Submergence Level dropping to a level below the intake section of the ESP. The control logic is configured to manage the setpoint for the Liquid Submergence Level to make it stable, in order to provide tight control over the Liquid Submergence Level, and hence over the PIP.

In addition, the control logic can be configured to adjust the operational frequency (speed) of the ESP, as this parameter also affects PIP pressure. In other embodiments, the operational frequency (speed) of the ESP can be adjusted manually via user configuration of the ESP controller 219, or by commands issued from the remote system 225, to control the optimization point of the system.

Figure 4:
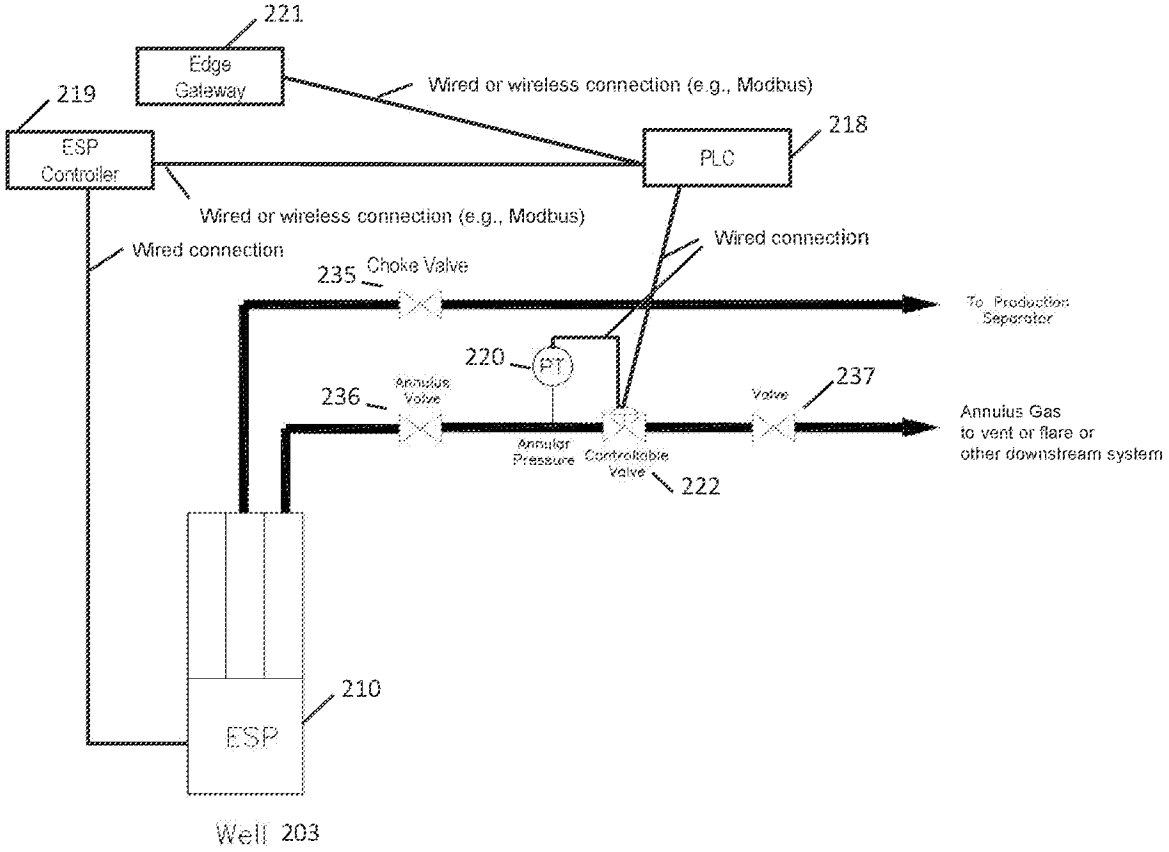
FIG. 4 is a schematic diagram illustrating a second embodiment of the subject disclosure.

FIG. 4 is a schematic diagram illustrating parts of an AGHS according to another embodiment of the present disclosure. In this embodiment, the gateway device 221 communicates with the ESP Controller 219 via an intermediate programmable logic controller (PLC) device 218. Furthermore, the gateway device 221 communicates with both the electrically-controllable valve 222 and the pressure sensor 220 that measures CHP via the same PLC device 218. The wellhead includes a choke valve 235 that regulates the flow of produced fluids from the production well 203 to a production flowline that leads to a downstream production separator. The AGHS also includes a manually actuated valve 236 integral to the flowline between annulus of the production well 203 and the valve 222 as well as a manually actuated valve 237 integral to the flowline between the outlet of the valve 222 and the downstream system for the release of annular gas, such as a vent, flare or other downstream system as described herein. The other components function in a manner similar to the embodiment of FIGS. 1 and 2 as described herein.

Figure 5:
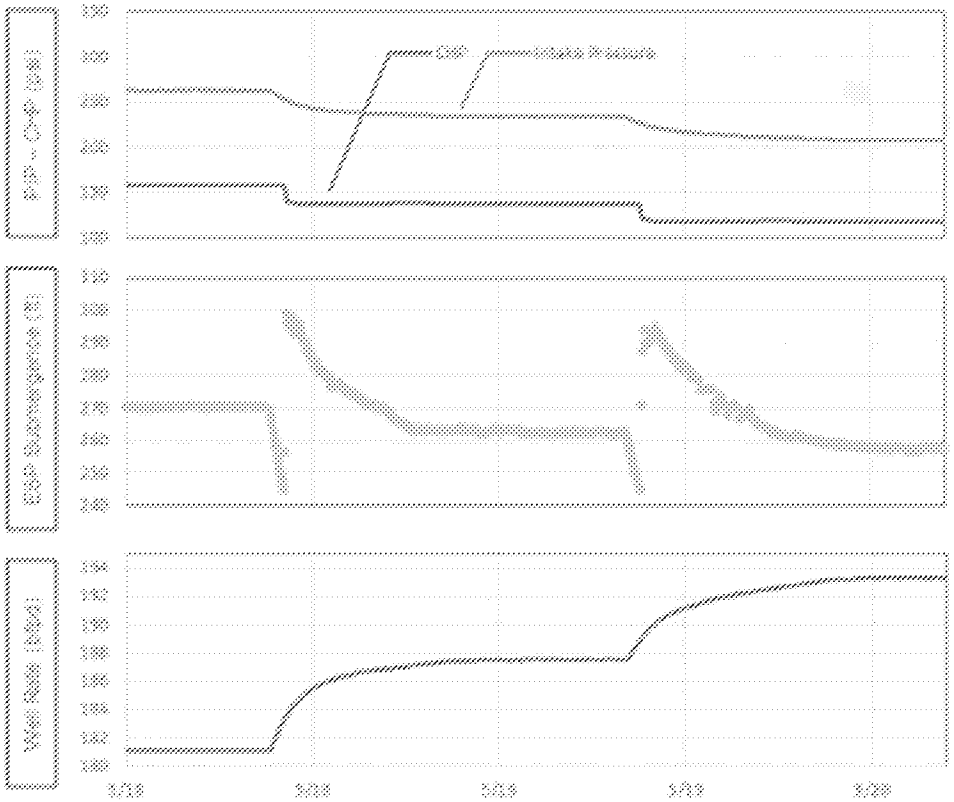
FIG. 5 depicts line graphs that illustrate the autonomous management and control of annular gas performed by the embodiment of FIGS. 1 and 2 as integrated into an example production well for a time period covering three days.

FIG. 5 includes these graphs illustrating the autonomous management and control of annular gas performed by the AGHS system of FIGS. 1 and 2 as integrated into an example production well for a time period covering three days. The top graph of FIG. 5 shows the autonomous control of CHP and PIP (in psi) over the time period. The middle graph of FIG. 5 shows the autonomous control of Liquid Submergence Level (in ft) over the time period. The bottom graph of FIG. 5 shows the flow rate of produced fluids (in barrels of fluid per day or BFPD) over the time period. Note that as the Liquid Submergence Level falls, the autonomous management and control automatically controls the electrically-controlled valve to release annular gas and the CHP drops. This causes the Liquid Submergence Level to increase rapidly and then level off at a Liquid Submergence Level setpoint that lowers the PIP pressure and increases the flow rate of the produced fluids over time.

The following is enabled with the embodiments of the subject disclosure as desired herein.

Autonomous CHP Control: Through the execution of the control logic, a CHP setpoint can be determined or obtained. This allows the control logic to perform autonomous operations that: (a) control the production well under dynamic variations that happen randomly in unstable wells; (b) control pressure build up and depressurization in the well annulus; (c) minimize pressure variations in the annulus allowing constant and stable flow of gas through the annulus; and (d) indirectly stabilize and optimize the liquid submergence level of the pump.

Autonomous PIP Control: Through the execution of the control logic, a PIP setpoint can be determined or obtained. In such embodiments, a downhole pressure sensor is used to measure the PIP to provide for control over the PIP. This allows the control logic to perform autonomous operations that: (a) control the production well under dynamic variations that happen randomly in unstable wells; (b) control pressure build up and depressurization in the well annulus; (c) minimize pressure variations in the annulus allowing constant and stable flow of gas through the annulus; (d) indirectly stabilize and optimize the liquid submergence level of the pump; (e) improve pump efficiency and fluid GVF; and (f) improve pump run life (by optimizing temperatures, drive frequency, etc.).

Pump Submergence: Based on the PIP and CHP, a computational model can be used to calculate in a streaming fashion the Liquid Submergence Level (liquid level above the pump). This allows the control logic to perform autonomous operations that: (a) minimizes pump submergence; (b) improves pump efficiency; and (c) allows optimization of the drive control of the pump.

Pump Submergence Control: Through the execution of the control logic, a Liquid Submergence Level setpoint can be determined or obtained. This allows the control logic to perform autonomous operations that: (a) stabilize and optimize pump submergence; (b) controls the well under dynamic variations that happen randomly in unstable wells; (c) control pressure build up and pressure losses on the annulus; (d) indirectly control liquid rate and productivity of the well; (e) improve pump efficiency and fluid GVF; and (f) improve pump run life (by optimizing temperatures, drive frequency, etc.).

The autonomous management and control of annular gas performed by the AGHS system of the subject disclosure can alleviate or reduce the need for a field technician to travel to the wellsite and depressurize manually the annulus. The autonomous management and control of annular gas performed by the AGHS system can replace these trips, allowing manipulation of the annular valve remotely and autonomously. This not only allows for well stability, but also to push the operating envelope of the well overall system.

In embodiments, the autonomous management and control of annular gas performed by the AGHS system of the subject disclosure provides for: Autonomous CHP Control; Autonomous PIP Control; Autonomous Pumps Submergence Control; control for Pump Start up solutions; optimization of pump efficiency; and improvement of run life.

In embodiments, the advantages of the system described herein include the following: improve well productivity; reduce production losses; reduce human intervention; provide for remote control; reduction or response time; and accurate knowledge and control over the operation of the production well.

Figure 6:
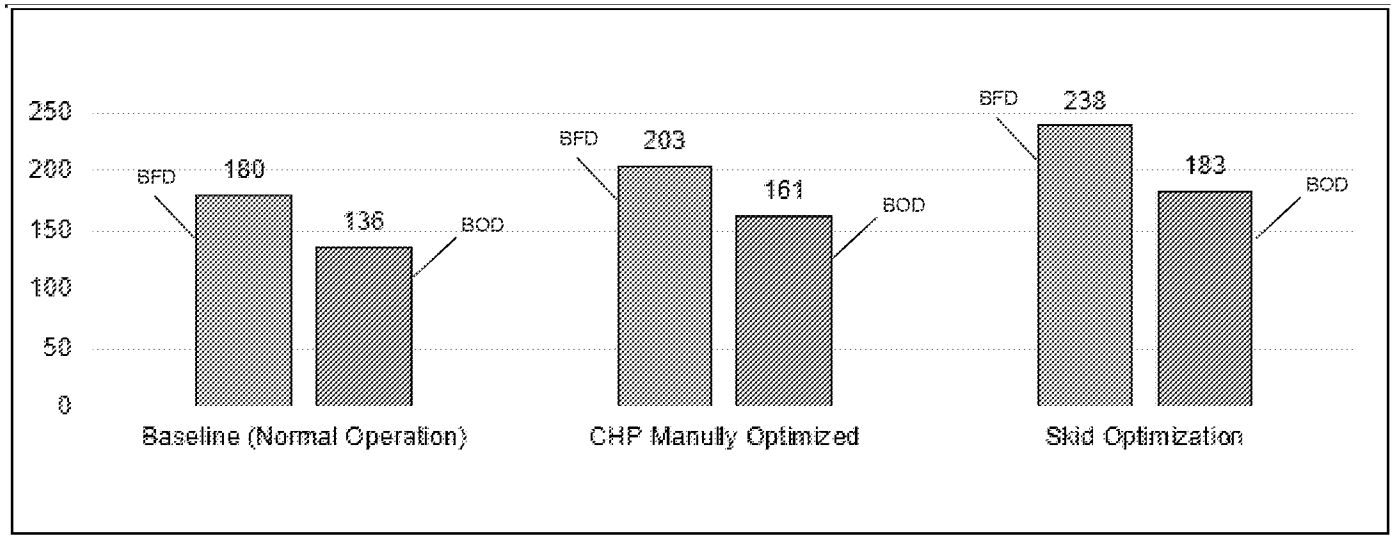
FIG. 6 depicts bar graphs that illustrate the improved production provided by the autonomous management and control of annular gas performed by the embodiment of FIGS. 1 and 2 as integrated into an example production well as compared to a baseline scenario (with no release of annular gas) and a scenario where annular gas accumulation and associated CHP is managed by manual intervention.

FIG. 6 are bar graphs that illustrate the improved production provided by the autonomous management and control of annular gas performed by the AGHS system of FIGS. 1 and 2 as integrated into an example production well as compared to a baseline scenario (with no release of annular gas) and a scenario where annular gas accumulation and associated CHP is managed by manual intervention. The two bar graphs on the left side of FIG. 6 illustrate the daily production of fluids and oil from the example production well in the baseline scenario. The two bar graphs in the middle of FIG. 6 illustrate the daily production of fluids and oil from the example production well in the scenario where annular gas accumulation and associated CHP is managed by manual intervention. The two bar graphs on the right side of FIG. 6 illustrate the daily production of fluids and oil from the example production well that results from autonomous management and control of annular gas performed by the AGHS system of FIGS. 1 and 2. Note that autonomous management and control of annular gas performed by the AGHS system results in increased daily production of both fluids and oil from the example production well as compared to both the baseline scenario and the scenario where annular gas accumulation and associated CHP is managed by manual intervention.

Note that in the description of the AGHS system as described above, an ESP is used for artificial lift. In other embodiments, the AGHS system can be adapted to employ another form of ALS, such as Progressive Cavity Pump (PCP) or Rod Pump. In these alternate embodiments, the ESP, the ESP Controller and ESP sensor(s)s as described above are substituted by the other form of ALS with suitable ALS control and ALS sensor(s).

Figure 7:
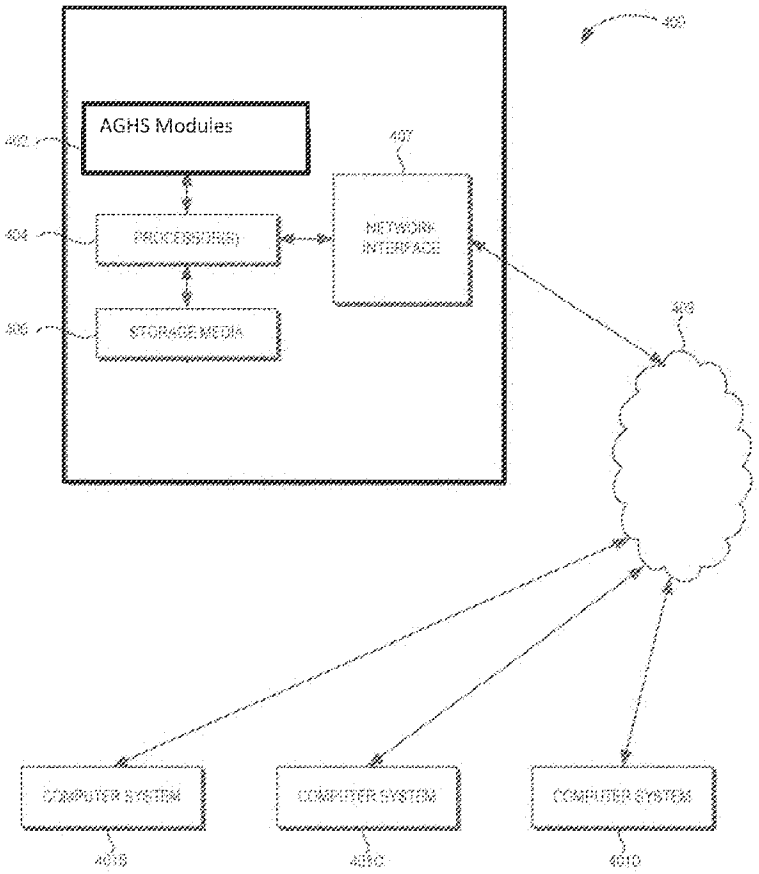
FIG. 7 is a schematic diagram of an example computing system.

In some embodiments, the methods and system of the present disclosure may involve a computing system. FIG. 7 illustrates an example of such a computing system 400, in accordance with some embodiments. The computing system 400 may include a computer or computer system 401A, which may be an individual computer system 401A or an arrangement of distributed computer systems. The computer system 401A includes one or more analysis modules 402 e.g., AGHS Modules that are configured to perform various tasks according to some embodiments, such as one or more methods or portions thereof as disclosed herein. To perform these various tasks, the analysis module(s) 402 executes independently, or in coordination with, one or more processors 404, which is (or are) connected to one or more storage media 406. The processor(s) 404 is (or are) also connected to a network interface 407 to allow the computer system 401A to communicate over a data network 409 with one or more additional computer systems and/or computing systems, such as 401B, 401C, and/or 401D (note that computer systems 401B, 401C and/or 401D may or may not share the same architecture as computer system 401A, and may be located in different physical locations, e.g., computer systems 401A and 401B may be located in a processing facility, while in communication with one or more computer systems such as 401C and/or 40ID that are located in one or more data centers, and/or located in varying countries on different continents).

A processor may include a microprocessor, microcontroller, processor module or subsystem, programmable integrated circuit, programmable gate array, or another control or computing device.

The storage media 406 may be implemented as one or more computer-readable or machine-readable storage media. Note that while in the example embodiment of FIG. 7 storage media 406 is depicted as within computer system 401A, in some embodiments, storage media 406 may be distributed within and/or across multiple internal and/or external enclosures of computing system 401A and/or additional computing systems. Storage media 406 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), other types of optical storage, or other types of storage devices. Note that the instructions discussed above may be provided on one computer-readable or machine-readable storage medium, or alternatively, may be provided on multiple computer-readable or machine-readable storage media distributed in a large system having plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

It should be appreciated that computing system 400 is only one example of a computing system, and that computing system 400 may have more or fewer components than shown, may combine additional components not depicted in the example embodiment of FIG. 7, and/or computing system 400 may have a different configuration or arrangement of the components depicted in FIG. 7. The various components shown in FIG. 7 may be implemented in hardware, software, or a combination of both hardware and software, including one or more signal processing and/or application specific integrated circuits.

Further, the steps in the processing methods and workflows described herein may be implemented by running one or more functional modules in information processing apparatus such as general-purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An automated system for managing gas in an annulus of a production well at a well site, the automated system comprising:

an electrically-controlled valve fluidly coupled to the annulus of the production well, wherein the valve is located at the surface at the well site;

at least one well sensor configured to measure operational characteristics of the production well at the surface; and a gateway device, located at the well site and operably coupled to the valve and the at least one well sensor, wherein the gateway device is configured to collect first sensor data communicated from the at least one well sensor, and process the first sensor data in autonomous control operations that automatically generate and issue commands that are communicated from the gateway device to the valve to regulate an outflow of accumulated gas from the annulus of the production well over time, wherein the production well employs an artificial lift system (ALS) to lift fluids through the production well to the surface with at least one ALS sensor that measures operational characteristics of the ALS, and the gateway device is operably coupled to the at least one ALS sensor, wherein the gateway device is configured to collect second sensor data communicated from the at least one ALS sensor, and process both the first sensor data and the second sensor data in the autonomous control operations that automatically generate and issue commands that are communicated from the gateway device to the valve to regulate the outflow of accumulated gas from the annulus of the production well over time, and wherein the gateway device is further configured to execute a computational model that calculates a virtual flow rate of produced fluid based on the first sensor data and the second sensor data, and the gateway device is further configured to communicate the virtual flow rate of produced fluid as calculated by the gateway device over time to a remote system.

2. The automated system of claim 1, wherein:

the at least one well sensor comprises a pressure sensor configured to measure casing head pressure of the production well at the surface; and the first sensor data comprises sensor data that represents the casing head pressure measured by the pressure sensor.

3. The automated system of claim 2, wherein:

the gateway device is further configured to use a setpoint value for the casing head pressure in the autonomous control operations.

4. The automated system of claim 1, wherein:

the at least one ALS sensor comprises a downhole sensor configured to measure pump intake pressure; and the second sensor data comprises sensor data that represents the pump intake pressure measured by the downhole sensor.

5. The automated system of claim 1, wherein:

the gateway device is further configured to use a setpoint value for pump intake pressure in the autonomous control operations.

6. The automated system of claim 1, wherein:

the gateway device is configured to execute a computational model that calculates a liquid submergence level for the ALS based on the first sensor data and the second sensor data; and the gateway device is further configured to use the liquid submergence level in the autonomous control operations.

7. The automated system of claim 6, wherein:

the computational model is configured to calculate the liquid submergence level for the ALS based on the first sensor data representing casing head pressure data and the second sensor data representing pump intake pressure and pump discharge pressure.

8. The automated system of claim 7, wherein:

the computational model is further configured to calculate the liquid submergence level for the ALS based on other inputs specific to the production well.

9. The automated system of claim 1, wherein:

the gateway device is further configured to communicate time-series operational data of the ALS and the automated system to the remote system for monitoring and visualization of operating conditions and status of the ALS and the automated system.

10. The automated system of claim 9, wherein:

the remote system is embodied by a cloud computing environment.

11. The automated system of claim 9, wherein:

the gateway is configured to receive communication from the remote system for remote control of the valve.

12. The automated system of claim 1, wherein:

the valve and the at least one well sensor are mounted on a skid that is located at the well site.

13. The automated system of claim 1, wherein:

the gateway device includes at least one communication interface providing direct or indirect communication between the gateway device and the valve and the at least one well sensor.

14. The automated system of claim 1, wherein: the ALS employs one of an Electrical Submersible Pump, a Progressive Cavity Pump, and a Rod Pump.

15. The automated system of claim 1, wherein:

the autonomous control operations are configured to perform at least one of the following: (a) stabilize and optimize a liquid submergence level of the ALS; (b) control the production well under dynamic variations that happen randomly in unstable wells; (c) control pressure build up and pressure losses on the annulus of the production well; (d) indirectly control liquid rate and productivity of the production well; (e) improve pump efficiency and fluid Gas Volume Fraction (GVF); and (f) improve run life of the ALS.

16. An automated system for managing gas in an annulus of a production well at a well site, the automated system comprising:

an electrically-controlled valve fluidly coupled to the annulus of the production well, wherein the valve is located at the surface at the well site;

at least one well sensor configured to measure operational characteristics of the production well at the surface; and a gateway device, located at the well site and operably coupled to the valve and the at least one well sensor, wherein the gateway device is configured to collect first sensor data communicated from the at least one well sensor, and process the first sensor data in autonomous control operations that automatically generate and issue commands that are communicated from the gateway device to the valve to regulate an outflow of accumulated gas from the annulus of the production well over time, wherein the production well employs an artificial lift system (ALS) to lift fluids through the production well to the surface with at least one ALS sensor that measures operational characteristics of the ALS, wherein the gateway device is operably coupled to the at least one ALS sensor, wherein the gateway device is configured to collect second sensor data communicated from the at least one ALS sensor, and process both the first sensor data and the second sensor data in the autonomous control operations that automatically generate and issue commands that are communicated from the gateway device to the valve to regulate the outflow of accumulated gas from the annulus of the production well over time, wherein the gateway device is configured to execute a computational model that calculates a liquid submergence level for the ALS based on the first sensor data and the second sensor data, wherein the gateway device is further configured to use the liquid submergence level in the autonomous control operations, and wherein the gateway device is further configured to use a setpoint value for the liquid submergence level in the autonomous control operations.

17. The automated system of claim 16, wherein:

the at least one well sensor comprises a pressure sensor configured to measure casing head pressure of the production well at the surface; and the first sensor data comprises sensor data that represents the casing head pressure measured by the pressure sensor.

18. The automated system of claim 17, wherein:

the gateway device is further configured to use a setpoint value for the casing head pressure in the autonomous control operations.

19. An automated system for managing gas in an annulus of a production well at a well site, the automated system comprising:

an electrically-controlled valve fluidly coupled to the annulus of the production well, wherein the valve is located at the surface at the well site;

at least one well sensor configured to measure operational characteristics of the production well at the surface; and a gateway device, located at the well site and operably coupled to the valve and the at least one well sensor, wherein the gateway device is configured to collect first sensor data communicated from the at least one well sensor, and process the first sensor data in autonomous control operations that automatically generate and issue commands that are communicated from the gateway device to the valve to regulate an outflow of accumulated gas from the annulus of the production well over time, wherein the production well employs an artificial lift system (ALS) to lift fluids through the production well to the surface with at least one ALS sensor that measures operational characteristics of the ALS, wherein the gateway device is operably coupled to the at least one ALS sensor, wherein the gateway device is configured to collect second sensor data communicated from the at least one ALS sensor, and process both the first sensor data and the second sensor data in the autonomous control operations that automatically generate and issue commands that are communicated from the gateway device to the valve to regulate the outflow of accumulated gas from the annulus of the production well over time, wherein the gateway device is further configured to communicate time-series operational data of the ALS and the automated system to a remote system for monitoring and visualization of operating conditions and status of the ALS and the automated system, and wherein the time-series operational data comprises a virtual flow rate of produced fluid calculated by the gateway device based on the first sensor data and the second sensor data.

20. The automated system of claim 19, wherein:

the remote system is embodied by a cloud computing environment.

* * * * *